US010060584B2

(12) United States Patent
Wouters et al.

(10) Patent No.: US 10,060,584 B2
(45) Date of Patent: Aug. 28, 2018

(54) LED LUMINAIRE

(71) Applicant: City Electric Supply Co., Orlando, FL (US)

(72) Inventors: Thomas Wouters, Stuart, FL (US); Jordan McGinn, Port Saint Lucie, FL (US); Francis Paul McShane, Palm City, FL (US)

(73) Assignee: City Electric Supply, Inc., Orlando, FL (US)

( * ) Notice: Subject to any disclaimer, the term of this patent is extended or adjusted under 35 U.S.C. 154(b) by 0 days.

(21) Appl. No.: 15/510,888

(22) PCT Filed: Sep. 9, 2015

(86) PCT No.: PCT/US2015/049120

§ 371 (c)(1),
(2) Date: Mar. 13, 2017

(87) PCT Pub. No.: WO2016/040436

PCT Pub. Date: Mar. 17, 2016

(65) Prior Publication Data

US 2017/0248286 A1 Aug. 31, 2017

Related U.S. Application Data

(60) Provisional application No. 62/049,195, filed on Sep. 11, 2014.

(51) Int. Cl.

| | |
|---|---|
| ***F21S 8/04*** | (2006.01) |
| *F21Y 115/10* | (2016.01) |
| *F21Y 107/20* | (2016.01) |
| *F21V 21/02* | (2006.01) |

(52) U.S. Cl.

CPC ..... *F21S 8/04* (2013.01); *F21S 8/043* (2013.01); *F21V 21/02* (2013.01); *F21Y 2107/20* (2016.08); *F21Y 2115/10* (2016.08)

(58) Field of Classification Search

CPC ..... F21Y 2107/10; F21Y 2107/00; F21Y 2107/30; F21S 8/04; F21V 21/02

See application file for complete search history.

(56) References Cited

U.S. PATENT DOCUMENTS

| | | | | |
|---|---|---|---|---|
| 6,183,100 B1 * | 2/2001 | Suckow | B60Q 1/2611 | 362/35 |
| 8,540,397 B2 * | 9/2013 | Gill | F21S 8/086 | 362/147 |
| 2003/0031015 A1 * | 2/2003 | Ishibashi | F21V 3/00 | 362/235 |
| 2009/0237922 A1 * | 9/2009 | Chiu | F21K 9/27 | 362/223 |

(Continued)

FOREIGN PATENT DOCUMENTS

| | | | |
|---|---|---|---|
| EP | 2014970 A1 * | 1/2009 | F21S 8/086 |
| EP | 2778502 A2 * | 9/2014 | F21V 29/83 |
| GB | 247758 A * | 2/1926 | D04B 7/04 |

*Primary Examiner* — Mariceli Santiago

(74) *Attorney, Agent, or Firm* — Abelman, Frayne & Schwab

(57) ABSTRACT

Area lighting with a luminaire constructed from an array of light-emitting diodes (LEDs) distributed along the convex surface segment of an elliptic torus provides a uniform light output to the surrounding area.

9 Claims, 5 Drawing Sheets

(56) References Cited

U.S. PATENT DOCUMENTS

| | | | | |
|---|---|---|---|---|
| 2011/0068686 | A1* | 3/2011 | Osawa | F21V 11/02 315/32 |
| 2011/0149568 | A1* | 6/2011 | Wilson | F21S 6/002 362/235 |
| 2011/0163681 | A1* | 7/2011 | Dau | F21V 19/003 315/191 |
| 2011/0163683 | A1* | 7/2011 | Steele | F21V 7/00 315/192 |
| 2015/0260353 | A1* | 9/2015 | Bhattarai | F21K 9/1355 362/235 |
| 2016/0123564 | A1* | 5/2016 | Quilici | F21V 23/003 362/233 |

* cited by examiner

LED LUMINAIRE

FIELD OF THE INVENTION

The invention relates to luminaires for area lighting that utilize light-emitting diodes (LEDs) distributed along the convex curved surface of a plurality of supporting members.

BACKGROUND OF THE INVENTION

Light-emitting diodes are quickly becoming a popular light source for indoor task and area lighting, providing high energy efficiency and long life expectancy. One drawback of the light-emitting diode is that for a typical installation of an LED-based luminaire mounted on a ceiling and directed straight down, the LEDs only provide light through a range of 120°, failing to illuminate the first 30° from the ceiling.

For example, the attached FIG. 1 illustrates a prior art installation 100 of a single LED 110 mounted on a ceiling 120 and pointed straight down, in which the LED 110 only provides light through a range of 120°, failing to illuminate the first 30° from the ceiling 120.

FIG. 2A illustrates another prior art installation 200 of a first, second, and third band of LEDs 210, 220, and 230, respectively. Such a prior art design may be seen, for example, in FIG. 14 of U.S. Pat. No. 8,750,671, granted to Kelly et al. on Jun. 10, 2014. In this configuration, each of the three bands of LEDs 210, 220, and 230 follows an arc, with the LEDs oriented normal to the arc. Thus, the center LED is aimed straight down, or nearly straight down, and the other LEDs are directed or aimed at an angle to the floor. Note that when this description mentions the orientation of an LED, it is with regard to the aimpoint of the output light.

As may be seen in FIG. 2B, if one assumes that an LED has a typical light distribution of 120°, then obtaining 180° coverage along one axis can be obtained by distributing a plurality of LEDs into a 60° arc 250, i.e., with the LED 260 at one end of each arc aimed at 30° above the floor in one direction, e.g., north, and with the LED 270 at the other end of each arc aimed at 30° above the floor in the opposite direction, e.g., south.

While this prior art design is an improvement over the problem presented by the construction where all LEDs are simply aimed straight down and directly at the floor below, e.g., as illustrated in FIG. 1, it still only provides a 180° lighting distribution along one axis. That is, as discussed above, each of the three bands of LEDs 210, 220, and 230 follows an arc. The apexes of each arcuate LED band 210, 220, and 230 are placed along horizontal line 240, being an axis perpendicular to the length of arcuate LED bands 210, 220, and 230. The center LEDs of LED bands 210, 220, and 230 are aimed straight down. Thus, the 180° distribution will only be present in the axis parallel to the length of arcuate LED bands 210, 220, 230, i.e., perpendicular to axis 240. Thus, in the example given, the 180° distribution would be present along the north-south axis, but the east-west axis would still only provide a 120° distribution.

What is required is an improved luminaire based on LEDs that provides illumination through a greater angular range, including up to 180°.

SUMMARY OF THE INVENTION

The present invention provides a substantial improvement in the distribution of illumination of an LED-based luminaire. The luminaire comprises a plurality of elliptical arcuate bands on each of which band are mounted in predetermined spaced-relation a plurality of LEDs, each having its axis of light emission aimed normal to the convex side of the band. For convenience, the bands on which the LEDs are mounted may be referred to hereinafter as the "LED bands".

The LED bands are arranged in an array such that the longitudinal axes of the bands are parallel when projected on the planar surface defined by the luminaire's adjacent base member. The apexes of the bands define an elliptical arc perpendicular to the longitudinal axes of the bands. The LED bands are oriented normal to the elliptical arc.

In a preferred embodiment, the LED array defines a portion of the outer surface of a torus. In an embodiment described in more detail below, the array includes 60° of the outer torus surface.

The luminaire configured and arranged as described to support the elliptical arcuate bands in the defined torroidal array will provide improved light output and can be constructed using any known combination of materials.

BRIEF DESCRIPTION OF THE DRAWINGS

Preferred embodiments of the invention are described herein below with reference to the drawings wherein.

DETAILED DESCRIPTION OF THE INVENTION

Figure 1:
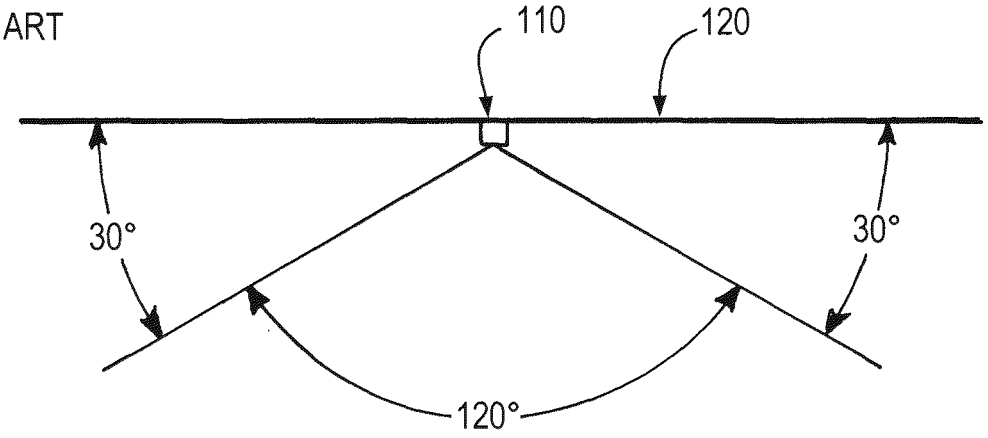
FIG. 1 PRIOR ART
FIG. 1 illustrates a prior art ceiling-mount of a single LED.
Figure 2A:
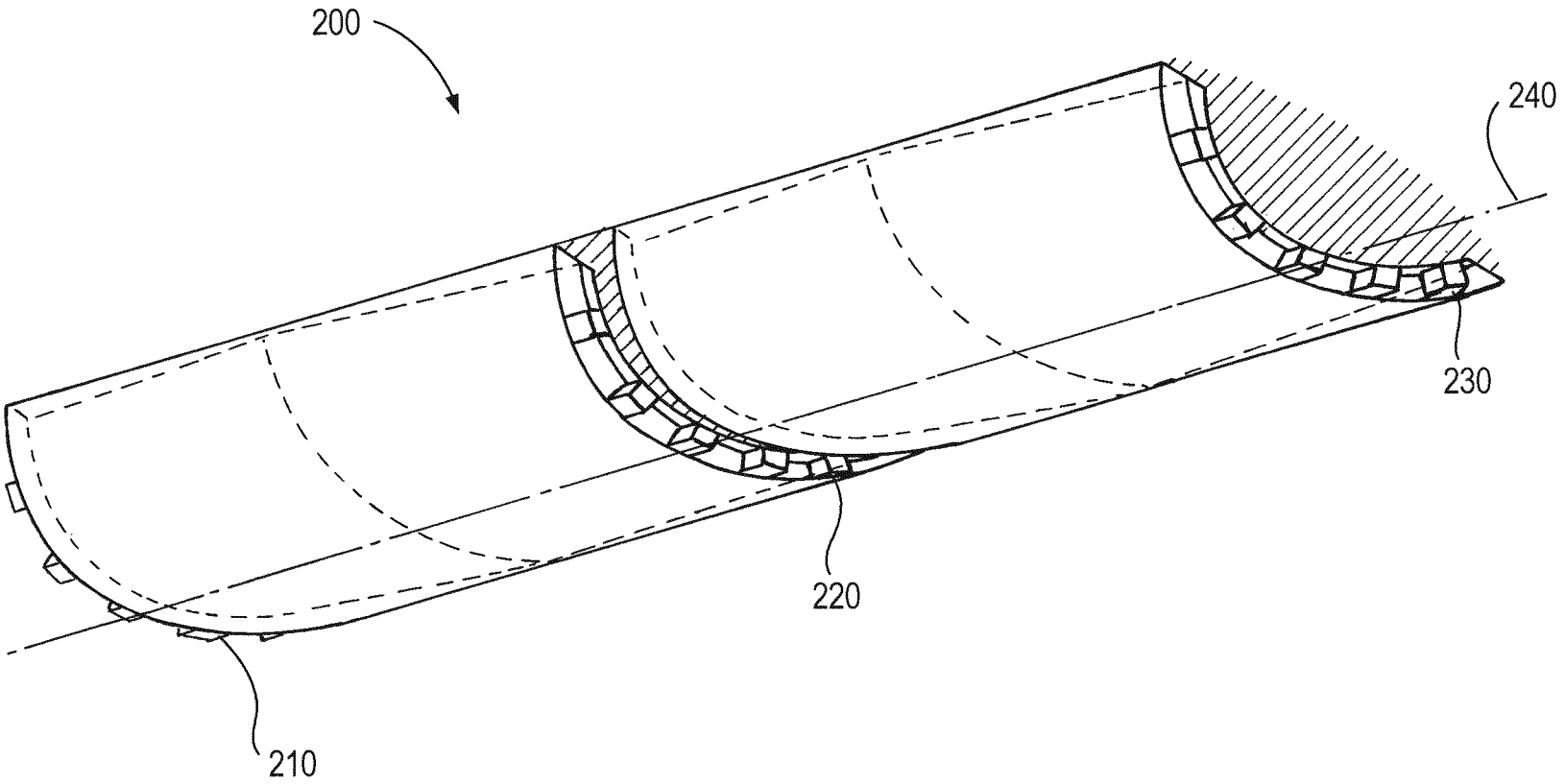
FIG. 2A PRIOR ART
FIG. 2A illustrates a prior art arcuate distribution of multiple LEDs.
Figure 2B:
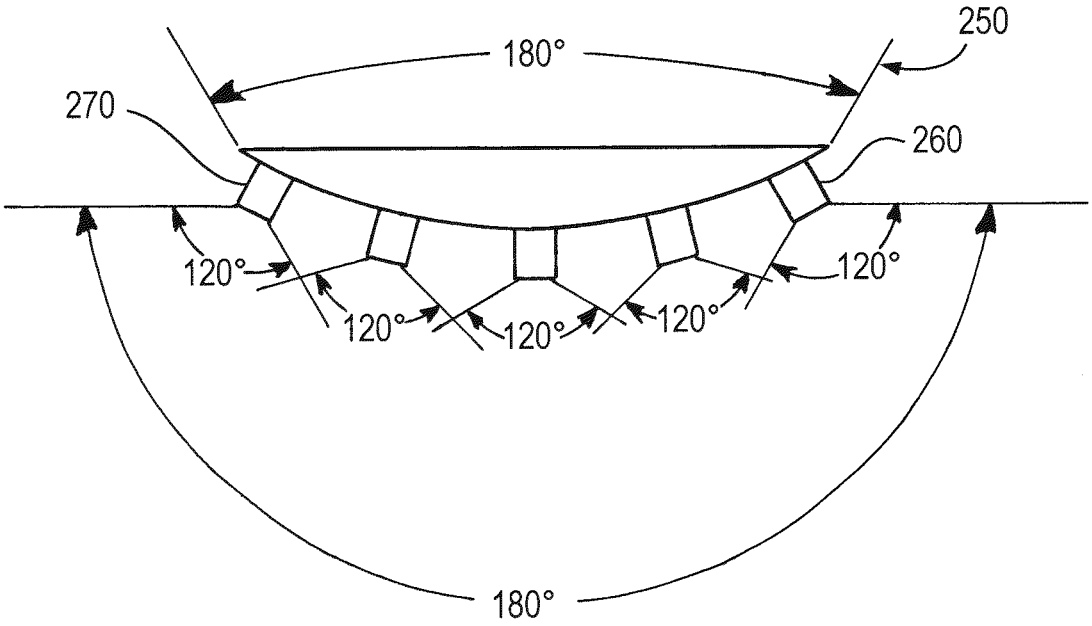
FIG. 2B PRIOR ART
FIG. 2B illustrates a prior art 180° light distribution along one axis.
Figure 3:
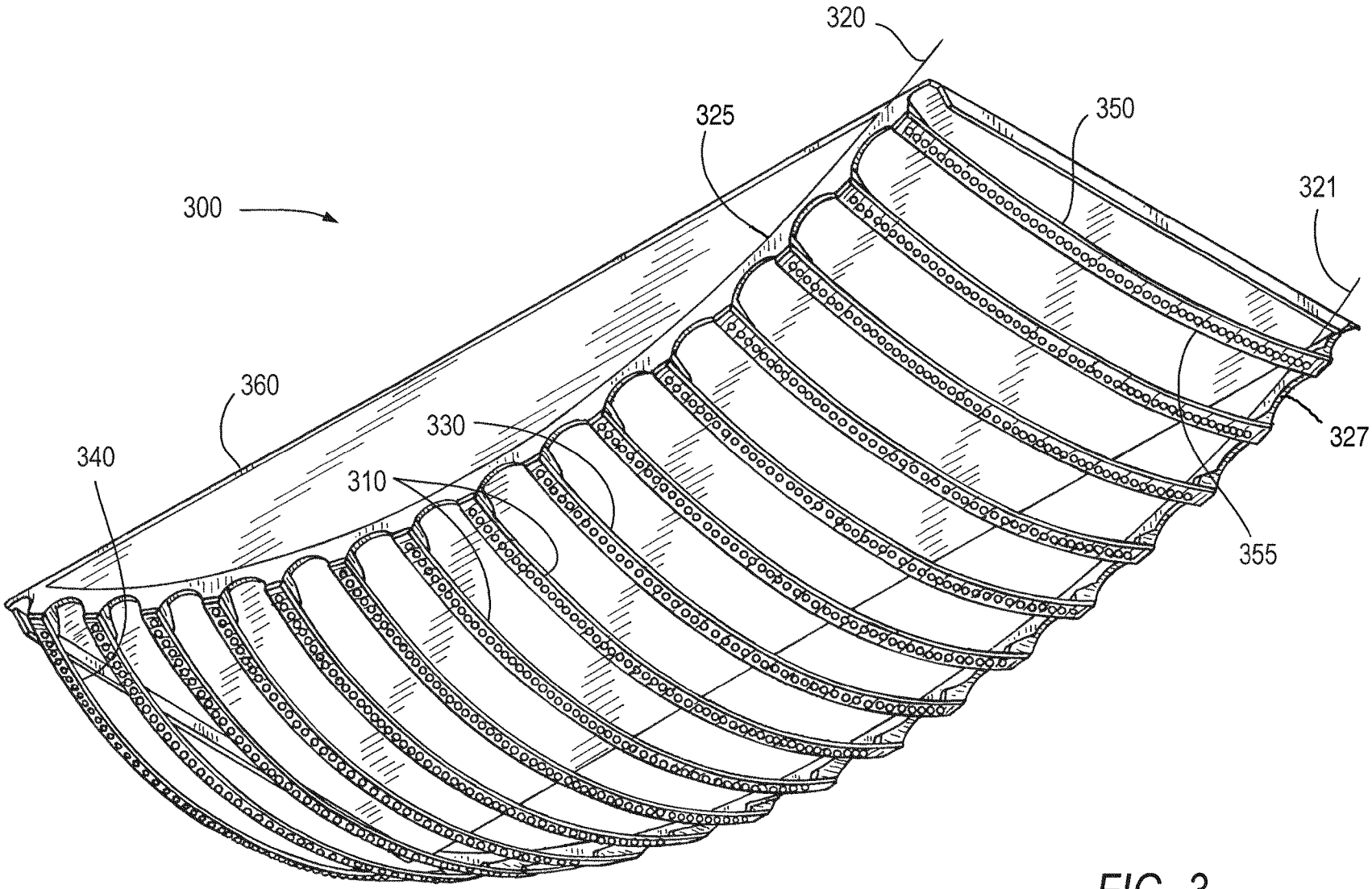
FIG. 3 illustrates an embodiment of the present invention.

Referring now to FIG. 3, there is illustrated a preferred embodiment of the present invention in which the luminaire 300 includes a planar base member 360 and a plurality of identical elliptical arcuate LED bands 310, each with opposing end portions and an intermediate apex. The LED bands 310 define a segment of an ellipse having a first major axis and first minor axis. In a preferred embodiment, the first major axis and first minor axis are equal, so that the LED bands 310 define arcs of a circle. Each LED band 310 is oriented so that a projection of the longitudinal axes of the bands onto the base member are parallel to each other. Distributed along the convex surface of LED band 310 are a plurality of LEDs, each of which are oriented and aimed normal to the adjacent surface of the band on which they are mounted.

Identical first and second elliptical arcuate members 325 and 327 are mounted perpendicular to base member 360, and preferably positioned on either side of the base member 360. The first and second elliptical arcuate members 325, 327 define arcs 320, 321 that are segments of an ellipse with a second major axis and a second minor axis. The plurality of LED bands 310 are secured in spaced-apart relation along a mounting surface of the first and second elliptical arcuate members 325, 327, such that the opposing end portions of each LED band 310 are positioned, respectively, on a mounting surface of the first and second arcuate members 325, 327, and each band of LEDs 310 is oriented normal to the surface defined by the first and second arcs 320, 321.

In a preferred embodiment, the second major axis and second minor axis of arcs 320, 321 are equal, defining arcs or segments of a circle. The first minor axis of the ellipse defined by LED bands 310 equals the second minor axis upon which the arcs 320, 321 of first and second elliptical arcuate members 325, 327 are based. The LEDs on each LED band 310 that are closest to the end portions of their respective LED bands are oriented at a predetermined angle below the plane defined by the surface of the base member 360.

From the above, it will be understood that the LED bands 310 each define a first arc that is a segment of an ellipse with a first major axis equal to 2c and a first minor axis equal to 2a. Arcs 320, 321 of first and second elliptical arcuate members 325, 327 each define a second ellipse that is a segment of an ellipse with a second major axis equal to 2b and a second minor axis equal to 2a.

The overall effect is that the LEDs are uniformly distributed along the convex surface segment of an elliptic torus, and thereby provide a more uniform light output. In an embodiment where the minor and major axes of the ellipse are equal, the torus is defined by the rotation of a circle about a line.

The first major axis, 2c, is preferably from one foot to eight feet in length. The second major axis, 2b, is preferably from one foot to two feet in length. The first and second minor axes, 2a, are preferably 21 inches to 45 inches in length. The luminaire 300 is preferably constructed with 10 to 25 LED bands 310.

Figure 4:
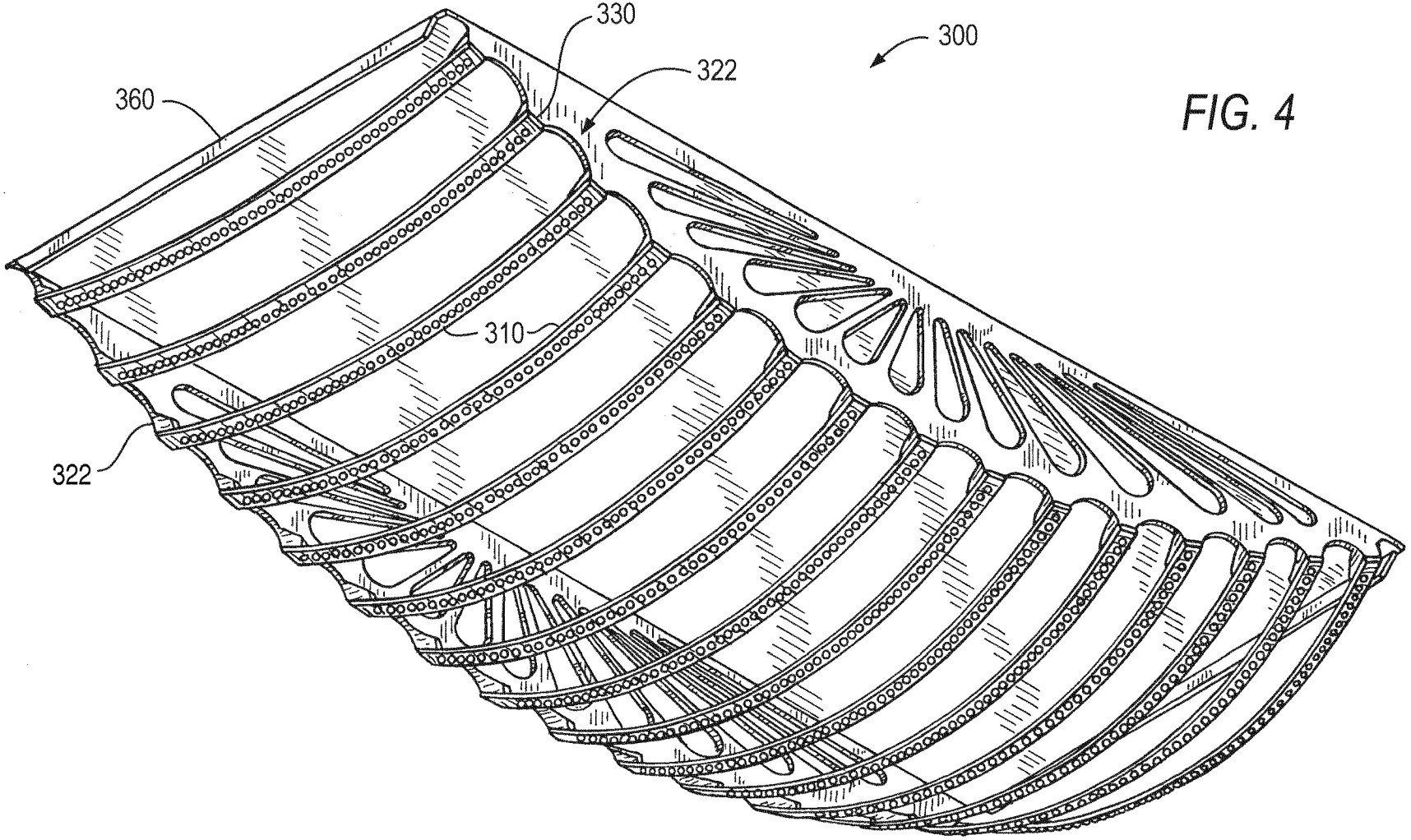
FIG. 4 illustrates another embodiment of the invention.

In the embodiment of FIG. 4, a center LED band 330 is secured in position at the apex of the arcuate members 325, 327. In other embodiments, the distribution of LED bands along arcuate members 325, 327 does not include an LED band placed at the apex. The specific configuration and spacing of the LEDs and the bands in the luminaire of this invention to obtain optimum lighting to meet predetermined requirements is within the skill in the art. Factors include distance from the luminaire to surfaces and/or areas to be lighted, light intensity desired, and the like.

While the typical LED has a light distribution of 120°, other distributions are possible. Thus, the aforementioned predetermined angle is preferably in a range from 15°-45°, and more preferably is approximately 30°.

In an embodiment of the invention illustrated in FIG. 3, base 360 of luminaire 300 is made preferably of a rigid material, such as steel, aluminum, or a reinforced thermoplastic. Each of the two elliptical arcuate members 325, 327 to which the ends of the bands of LEDs 310 is secured are fabricated from an elongated element of metal, i.e., a strip of aluminum or steel, or a polymer reinforced with glass fibers or carbon filaments. The elliptical arcuate members 325, 327 can also be in the form of an "L"-shaped flange, a "T" or a "C" to provide greater rigidity, should that characteristic be required due to the size of the luminaire. The opposing ends of each of the elliptical arcuate members 325, 327 of this embodiment can be dimensioned and configured to facilitate its secure mounting on the base member 360 by mechanical fasteners, e.g., rivets, or by spot welding, or by other means known in the art.

The contact surfaces of elliptical arcuate members 325, 327 can be constructed of the same or similar rigid material as base 360. Alternatively, instead of arcuate members 325, 327 being formed from narrow strips as described above, they can be the elliptical arcuate edges of side support panels 322. If side support panels 322 are utilized, they can be solid, or can be perforated to reduce weight and/or provide a decorative pattern. FIG. 4 shows an embodiment in which side support panels 322 are formed from the same metal sheet as base member 360, e.g., by bending it to a position normal to the base. The panels 322 are perforated to form a decorative sunburst pattern which also reduces the weight of the luminaire. It is to be noted that in FIG. 4 the edges of side support panels 322 appear scalloped in nature, but the apexes of the scallops are dimensioned and arranged to define the respective elliptical arcuate surface for mounting as with elliptical arcuate members 325, 327.

The LED bands 310 can be made of any rigid or flexible substrate materials that are approved for LED-mounting. The LED bands 310 are securely attached to the arcuate members 325, 327 by any known means such as screws, bolts, and/or rivets, or by spot welding.

A wide range of LEDs are suitable for use in this invention. In a preferred embodiment, LEDs with a color temperature of 3000 to 7000 Kelvin can be used, and from 30 to 60 LEDs are mounted to each LED band 310, with uniform longitudinal spacing along the band.

The luminaire 300 can also include a power supply, which in a preferred embodiment can be a dimmable driver with an input (line) voltage of 120-480 VAC+/−10%, and wiring between the LEDs and the driver. Conventional means can be provided for wiring the luminaire 300, such as a pigtail or a wiring terminal.

In another embodiment (not shown), an LED-based luminaire is constructed of similar elements, except that the LED bands 310 are replaced by a solid toroidal surface having a configuration as defined above with LEDs uniformly distributed across the convex side of the surface. Such an embodiment is equivalent to increasing the number of LED bands 310, or increasing their width, until there is no gap between bands.

The invention includes flush and surface ceiling mounting, as well as pendant-mounted luminaires.

While preferred embodiments of the present invention have been illustrated and described herein, it will be apparent that such embodiments are provided by way of example only. Numerous variations, changes and substitutions will be apparent to those skilled in the art without departing from the invention, the scope of which is to be determined by the following claims.

We claim:

1. A luminaire comprising:

a base member defining a generally planar surface;

a plurality of elliptical arcuate LED bands mounted in spaced-apart relation, and displaced from the surface of the base member, wherein each arcuate LED band comprises:

opposing end portions and an apex, the concavity of each arcuate band facing the base member;

a plurality of LEDs operatively mounted in spaced relation along the convex surface of each of the arcuate LED bands, each LED oriented normal to the arcuate LED band upon which it is mounted;

wherein the plurality of arcuate LED bands are in spaced-apart relation to a mounting surface of first and second elliptical arcuate members extending along opposing sides of the base member, wherein the first and second elliptical arcuate members extend above the surface of the base member, each first and second elliptical arcuate members having opposing end portions and an intermediate apex, with the concavity of each elliptical arc facing the base, such that the opposing end portions of each arcuate LED band are positioned, respectively, on the mounting surface of the first and second elliptical arcuate members, and the LEDs on each arcuate LED band are oriented normal to the mounting surface of the first and second elliptical arcuate members to which the band is attached; and wherein the LEDs on each arcuate LED band that are closest to the end portions of their respective arcuate LED band are oriented at a predetermined angle below the planar surface of the base member.

2. The luminaire of claim 1 in which the first and second elliptical arcuate members are secured to the base member.

3. The luminaire of claim 1 in which the first and second elliptical arcuate members are the upper edges of side panels that are integrally formed with the base member.

4. The luminaire of claim 1 in which the first and second elliptical arcuate members are the upper edges of side panels that are joined to, and form a right angle with the base members.

5. The luminaire of claim 1 in which the first and second elliptical arcuate members are the upper edges of side panels that are joined to, and form an acute angle with the base member.

6. The luminaire of claim 1 in which each of the first and second elliptical arcuate members are elongated elements, the opposing ends of which are configured and dimensioned to be secured to the base member.

7. The luminaire of claim 1 that is configured for (a) flush-mounting in a ceiling, (b) surface mounting on a ceiling, or (c) pendant mounting from a ceiling.

8. The luminaire of claim 3 in which the side panels include one or more openings.

9. The luminaire of claim 8 in which the openings define a decorative pattern.

* * * * *